US007466277B2

(12) United States Patent
Ishizuka et al.

(10) Patent No.: US 7,466,277 B2
(45) Date of Patent: Dec. 16, 2008

(54) ANTENNA DEVICE AND WIRELESS COMMUNICATION APPARATUS

(75) Inventors: Kenichi Ishizuka, Sagamihara (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/954,521

(22) Filed: Dec. 12, 2007

(65) Prior Publication Data

US 2008/0079642 A1 Apr. 3, 2008

Related U.S. Application Data

(63) Continuation of application No. PCT/JP2006/306701, filed on Mar. 30, 2006.

(30) Foreign Application Priority Data

Jun. 17, 2005 (JP) ..... 2005-177764

(51) Int. Cl.
*H01Q 1/24* (2006.01)

(52) U.S. Cl. ..... 343/702; 343/700 MS

(58) Field of Classification Search ..... 343/702, 343/700 MS, 829, 830, 846
See application file for complete search history.

(56) References Cited

U.S. PATENT DOCUMENTS 6,177,908 B1 * 1/2001 Kawahata et al. ..... 343/700 MS
6,201,502 B1 3/2001 Kurita et al.
6,707,427 B2 3/2004 Konishi et al.
6,850,195 B2 2/2005 Onaka et al.
6,946,994 B2 9/2005 Imaizumi et al.
6,965,346 B2 * 11/2005 Sung et al. ..... 343/702
7,148,851 B2 12/2006 Takaki et al.
7,196,664 B2 * 3/2007 Asai ..... 343/700 MS
7,319,431 B2 * 1/2008 Jeon et al. ..... 343/700 MS
2005/0078038 A1 * 4/2005 Takaki et al. ..... 343/702

FOREIGN PATENT DOCUMENTS

JP 7-20708 U 4/1995
JP 8-23218 A 1/1996

(Continued)

OTHER PUBLICATIONS

Official communication issued in the International Application No. PCT/JP2006/306701, mailed on May 2, 2006.

*Primary Examiner*—Tho G Phan
(74) *Attorney, Agent, or Firm*—Keating & Bennett, LLP

(57) ABSTRACT

A compact and thin antenna device can be mounted in a small area of a substrate and has a multiband capability adaptable to various applications. The antenna device includes a chip antenna, an antenna element, and a chip antenna. The chip antenna is produced by forming a radiation electrode on the surface of a dielectric base, and mounting a frequency variable circuit on the radiation electrode. Thus, it becomes possible to obtain a resonant frequency f1 of the chip antenna and further to vary the resonant frequency f1. The antenna element is produced by adding an auxiliary element to an additional radiation electrode for the chip antenna. The chip antenna includes a radiation electrode on a dielectric base and a conductive pattern. Thus, a resonant frequency f2 and a resonant frequency f3 of the antenna element and the chip antenna, respectively, can be obtained.

12 Claims, 11 Drawing Sheets

FOREIGN PATENT DOCUMENTS

| | | | |
|---|---|---|---|
| JP | 8-204431 | A | 8/1996 |
| JP | 09-093031 | A | 4/1997 |
| JP | 11-004117 | A | 1/1999 |
| JP | 11-068456 | A | 3/1999 |
| JP | 2000-114992 | A | 4/2000 |
| JP | 2002-158529 | A | 5/2002 |
| JP | 2002-319811 | A | 10/2002 |
| JP | 2004-23210 | A | 1/2004 |
| JP | 2004-165770 | A | 6/2004 |
| JP | 2005-20266 | A | 1/2005 |
| JP | 2005-117099 | A | 4/2005 |

* cited by examiner

ANTENNA DEVICE AND WIRELESS COMMUNICATION APPARATUS

BACKGROUND OF THE INVENTION

1. Field of the Invention

The present invention relates to an antenna device for use in mobile phones or the like, and also to a wireless communication apparatus.

2. Description of the Related Art

In recent years, as the size of a wireless communication apparatus, such as a mobile phone, has decreased and density therein has increased, it is becoming necessary that an antenna device be mounted in a small area of a substrate.

However, mounting an antenna device in a small area requires a reduction in the size and thickness of the antenna device, and thus may degrade the antenna characteristics.

Therefore, for example, as disclosed in Japanese Unexamined Patent Application Publication No. 2000-114992, Japanese Unexamined Patent Application Publication No. 2004-023210, Japanese Unexamined Utility Model Registration Application Publication No. 07-020708, and Japanese Unexamined Patent Application Publication No. 2004-128605, various types of antenna devices having been made smaller and thinner without degrading the antenna characteristics have been proposed. Additionally, frequency variation techniques and an active antenna integral with an amplifier have been developed.

An antenna device disclosed in Japanese Unexamined Patent Application Publication No. 2000-114992 is an antenna having a loop radiation electrode. By connecting radiation electrodes formed on the upper and lower surfaces of a substrate through a through hole, the entire antenna is formed into a loop. A compact antenna device with improved radio radiation characteristics can thus be achieved.

An antenna device disclosed in Japanese Unexamined Patent Application Publication No. 2004-023210 is a dipole antenna in which two antenna elements are arranged to form a single plane, and power is fed to the two antenna elements in a balanced manner. This contributes to the prevention of noise and the reduced thickness of the antenna device.

An antenna device disclosed in Japanese Unexamined Utility Model Registration Application Publication No. 07-020708 is a coil antenna. The characteristics of a coil antenna largely depend on its thickness (specifically, the diameter of a winding core). In this antenna device, therefore, the coil antenna is inserted into a hole provided in a substrate. This reduces the thickness of the entire antenna device without degrading the antenna characteristics.

An antenna device disclosed in Japanese Unexamined Patent Application Publication No. 2004-128605 is a quarter-wavelength patch antenna or an inverted F antenna. The characteristics of such an antenna are largely influenced by the distance from a ground surface of a substrate to a radiation electrode. Therefore, in this antenna device, the radiation electrode of the antenna is extended from the upper side to the underside of the substrate at an end thereof. This reduces the thickness of the entire antenna device without degrading the antenna characteristics.

Other antenna devices similar to those described above are disclosed in Japanese Unexamined Patent Application Publication No. 08-023218 and Japanese Unexamined Patent Application Publication No. 2004-165770.

However, known antenna devices described above have the following problems.

Since the antenna device disclosed in Japanese Unexamined Patent Application Publication No. 2000-114992 is a loop antenna, a larger loop diameter increases dead space. Moreover, since the loop antenna is composed of a radiation electrode formed on the upper and lower surfaces of the substrate, the dead space extends not only over one surface but also over both surfaces of the substrate. This creates dead space that is double or more than double the normal amount. Furthermore, if the design of, for example, a housing of a wireless communication apparatus is altered, the radiation electrode of the antenna needs to be totally redesigned.

The antenna device disclosed in Japanese Unexamined Patent Application Publication No. 2004-023210 is a dipole antenna in which two antenna elements are arranged to form a single plane. Although the thickness of the device can be reduced in this case, it is not possible to reduce the size of the entire device. Moreover, since alignment including the balancing of feeding parts in the antenna device is very complicated, design work for the alignment takes a long time.

To produce an antenna device disclosed in Japanese Unexamined Utility Model Registration Application Publication No. 07-020708 or Japanese Unexamined Patent Application Publication No. 2004-128605, it is required that a coil antenna be inserted into a hole provided in a substrate or a radiation electrode be extended from the upper side to the underside of a substrate at an end thereof. This involves difficult alignment of both configurations and antenna characteristics.

Japanese Unexamined Patent Application Publication No. 2000-114992, Japanese Unexamined Patent Application Publication No. 2004-023210, Japanese Unexamined Utility Model Registration Application Publication No. 07-020708, and Japanese Unexamined Patent Application Publication No. 2004-128605 are discussed on the assumption that the disclosed antennas are single resonance antennas. Therefore, if a multiple-resonance antenna device or a frequency-variable antenna device is produced with any one of the techniques described above, dead space that is double or more than double the normal amount is created or the size of the antenna device increases. In other words, it is virtually impossible to incorporate such an antenna device into a wireless communication apparatus, where compactness and high board density are required. Similar problems arise in the antenna devices disclosed in Japanese Unexamined Patent Application Publication No. 08-023218 and Japanese Unexamined Patent Application Publication No. 2004-165770.

SUMMARY OF THE INVENTION

In order to overcome the problems described above, preferred embodiments of the present invention provide a compact and thin antenna device that can be mounted in a small area of a substrate and has a multiband capability adaptable to various applications, and provide a wireless communication apparatus.

An antenna device according to a preferred embodiment of the present invention includes a first chip antenna including a first radiation electrode and a frequency variable circuit arranged to vary an electrical length of the first radiation electrode that are provided on a dielectric or magnetic base mounted on an upper side of a non-ground region of a substrate; at least one antenna element including an additional radiation electrode provided on the base of the first chip antenna and an auxiliary element disposed on the upper side or an underside of the non-ground region and connected to the additional radiation electrode, and having a predetermined electrical length; and a second chip antenna including a second radiation electrode disposed on the dielectric or magnetic base mounted on the upper side or underside of the non-ground region of the substrate, and having a predetermined electrical length.

These antennas interfere with each other, generate a plurality of resonant frequencies, and are capable of sending and receiving a plurality of signals at different frequencies. Moreover, since the auxiliary element of the antenna element is disposed on one or both the upper side and underside of the non-ground region, it is possible to reduce dead space and the size of the entire antenna device, and further to improve antenna characteristics.

The antenna element is preferably formed by connecting the auxiliary element disposed on the underside of the non-ground region to the additional radiation electrode through a through hole provided in the non-ground region.

The number of the antenna elements preferably is more than one, and all resonant frequencies of the plurality of antenna elements are preferably different.

The auxiliary element of the antenna element preferably is a planar electrode produced by forming a conductive pattern in the non-ground region.

The auxiliary element of the antenna element preferably is a three-dimensional electrode including a supporting portion vertically disposed in the non-ground region while being connected to the additional radiation electrode, and a parallel portion extending substantially parallel to the substrate from an end of the supporting part.

With this configuration, since the auxiliary element of the antenna element is a three-dimensional electrode, it is possible to effectively extend the electrode spatially, as well as horizontally.

The parallel portion of the auxiliary element preferably is strip-shaped.

The parallel portion of the auxiliary element preferably is in the shape of a flat plate.

The size of the parallel portion of the auxiliary element is set such that the parallel portion does not extend beyond the non-ground region.

An end of the parallel portion of the auxiliary element preferably is an open end.

The auxiliary element disposed on the underside of the non-ground region is disposed on the dielectric or magnetic base mounted on the underside.

With this configuration, since the base on which the auxiliary element is disposed is made of dielectric material or the like having a wavelength reduction effect, it is possible to adjust the resonant frequency of the antenna element.

A feeding element for the second chip antenna is preferably different from that for the first chip antenna.

A wireless communication apparatus according to another preferred embodiment of the present invention includes an antenna device according to the above-described preferred embodiments.

With an antenna device according to various preferred embodiments of the present invention, signals at different resonant frequencies can be sent and received by the first chip antenna, at least one antenna element, and the second chip antenna. In other words, the antenna device is configured to allow multiple resonance. Therefore, an antenna device having the capability of multiband transmission and reception, and thus adaptable to various applications can be provided. Moreover, since the auxiliary element of the antenna element is disposed on one or both of the upper side and underside of the non-ground region, it is possible to reduce dead space and the size of the entire antenna device without degrading antenna performance.

In particular, by disposing the auxiliary element of the antenna element on the underside of the non-ground region, the antenna volume of the entire antenna device, including the first and second chip antennas and the antenna element, can be efficiently increased. In other words, by disposing the auxiliary element on the underside of the non-ground region where there is virtually no limitation on the electrode shape and size, an antenna volume larger than that of known antennas can be obtained.

Moreover, since alignment in the antenna device is easy, design work for the alignment can be completed in a short time.

With an antenna device according to various preferred embodiments of the present invention, the auxiliary element of the antenna element preferably is a three-dimensional electrode and thus can be effectively used spatially, as well as horizontally. Therefore, it is possible to realize an antenna device that uses not only space near the non-ground region, but all dead space in the housing of the apparatus in which the antenna device is incorporated. For example, it is possible to form the auxiliary element to fit the outline of a wireless communication apparatus, such as a mobile phone.

With the antenna device according to a preferred embodiment of the present invention, since the base made of dielectric material or the like having a wavelength reduction effect enables the adjustment of the resonant frequency of the antenna element, it is possible to provide an antenna device having the capability of multiband transmission over a wider band.

With the wireless communication apparatus according to a preferred embodiment of the present invention, it is possible to provide a compact and thin multiband wireless communication apparatus.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments and best modes for carrying out the present invention will now be described with reference to the drawings.

First Preferred Embodiment

Figure 1:
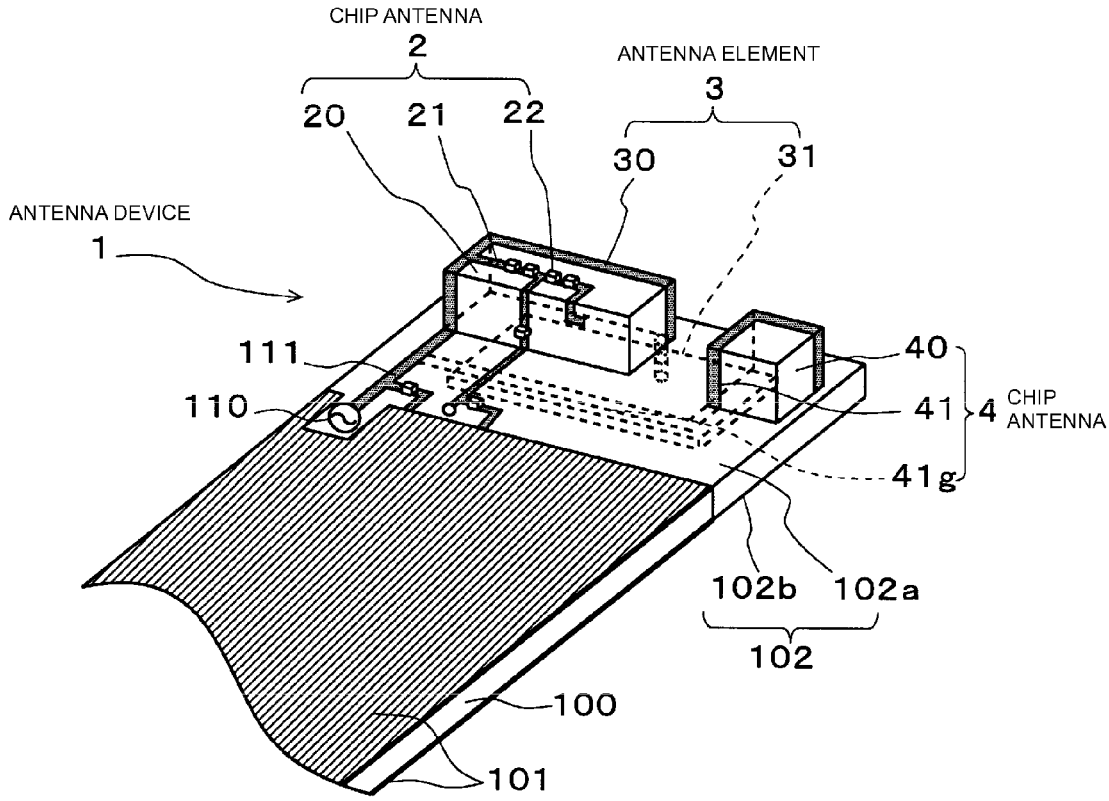
FIG. 1 is a perspective view illustrating the upper side of an antenna device according to a first preferred embodiment of the present invention.
Figure 2:
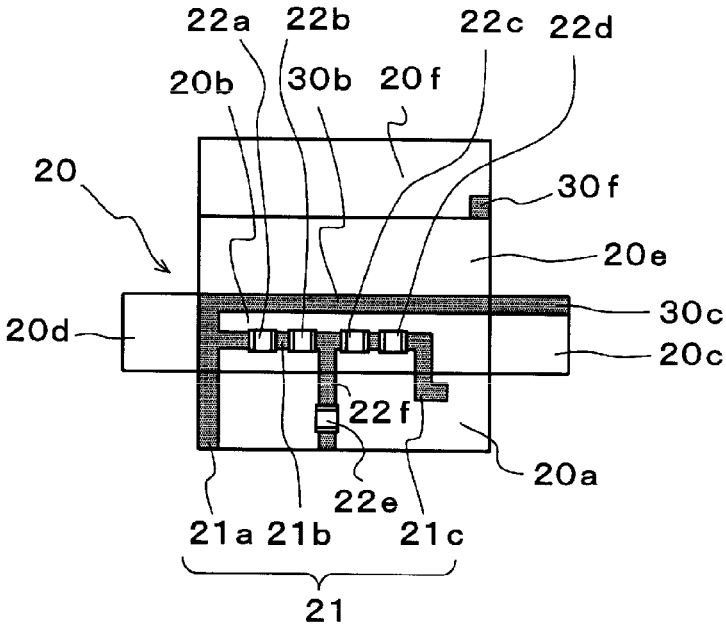
FIG. 2 is a plan view of a first chip antenna developed along sides thereof.
Figure 3:
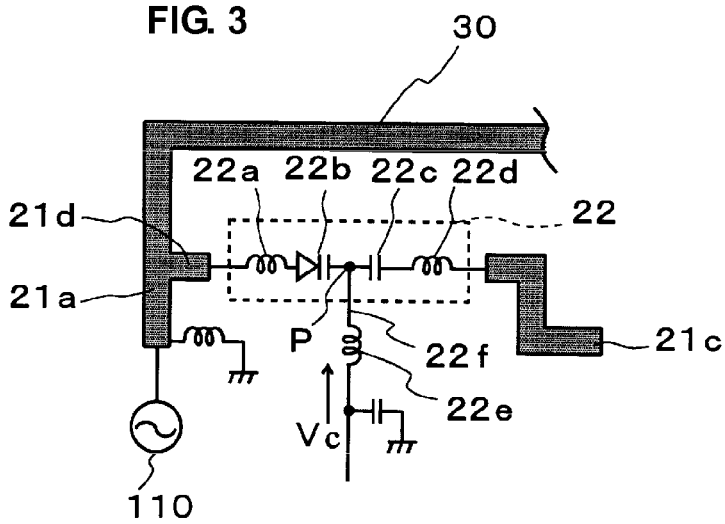
FIG. 3 is an equivalent circuit diagram of a frequency variable circuit.

FIG. 1 is a perspective view illustrating the upper side of an antenna device according to a first preferred embodiment of the present invention. FIG. 2 is a plan view of a first chip antenna developed along sides thereof. FIG. 3 is an equivalent circuit diagram of a frequency variable circuit.

An antenna device 1 of the present preferred embodiment is mounted on a wireless communication apparatus, such as a mobile phone.

As illustrated in FIG. 1, the antenna device 1 includes a chip antenna 2 serving as a first chip antenna, an antenna element 3, and a chip antenna 4 serving as a second chip antenna.

The chip antenna 2 is a surface-mount chip antenna produced by forming a radiation electrode 21 serving as a first radiation electrode, and a frequency variable circuit 22 on the surface of a dielectric base 20.

A ground region 101 and a non-ground region 102 are disposed on both surfaces of a substrate 100, while the dielectric base 20 of the chip antenna 2 is mounted on an upper side 102*a* of the non-ground region 102. Specifically, as illustrated in FIG. 2, the dielectric base 20 preferably has a substantially rectangular parallel piped shape and has a front surface 20*a*, an upper surface 20*b*, both side surfaces 20*c* and 20*d*, a back surface 20*e*, and a lower surface 20*f*.

The radiation electrode 21 is a strip of constant width and includes a front electrode section 21*a*, an upper electrode section 21*b*, and an end electrode section 21*c*. Specifically, the front electrode section 21*a* is formed on the left edge of the front surface 20*a* of the dielectric base 20 and, as illustrated in FIG. 1, one end of the front electrode section 21*a* is connected to a power feeder 110 (power feeding means) through a conductive pattern 111. Then, as illustrated in FIG. 2, the other end of the front electrode section 21*a* is connected to the upper electrode section 21*b*, which is connected to the end electrode section 21*c* formed on the front surface 20*a*.

In other words, as illustrated in FIG. 1 and FIG. 2, the radiation electrode 21 of the chip antenna 2 has a structure in which the front electrode section 21*a* is connected to the power feeder 110 through the conductive pattern 111, the upper electrode section 21*b* and the end electrode section 21*c* are connected to the front electrode section 21*a*, and the frequency variable circuit 22 is mounted on the upper electrode section 21*b*.

As illustrated in FIG. 2 and FIG. 3, the frequency variable circuit 22 is a series circuit of a coil 22*a*, a variable-capacitance diode 22*b*, a capacitor 22*c*, and a coil 22*d*. The frequency variable circuit 22 is configured such that a pattern 22*f* including a coil 22*e* is connected to a connection point P between the variable-capacitance diode 22*b* and the capacitor 22*c*. Thus, by applying a control voltage Vc to the connection point P through the pattern 22*f* and controlling the capacitance of the variable-capacitance diode 22*b*, the electrical length of the radiation electrode 21 can be varied.

The antenna element 3 includes, as illustrated in FIG. 1, a strip-shaped additional radiation electrode 30 and an auxiliary element 31 connected to the additional radiation electrode 30.

Figure 4:
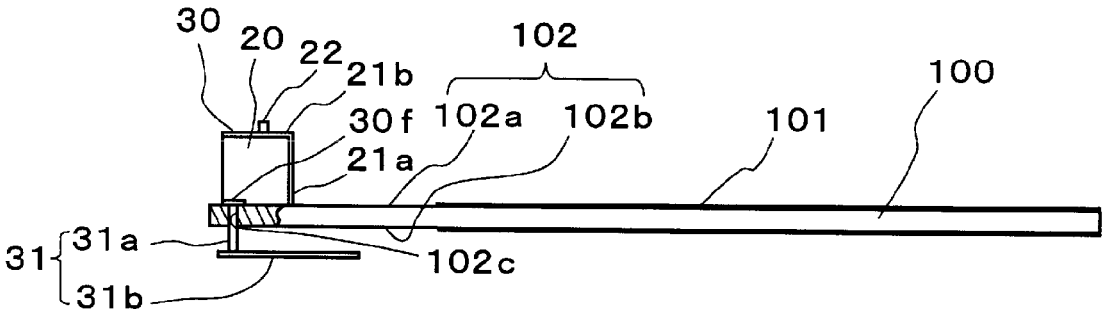
FIG. 4 is a cutaway side view of the antenna device.
Figure 5:
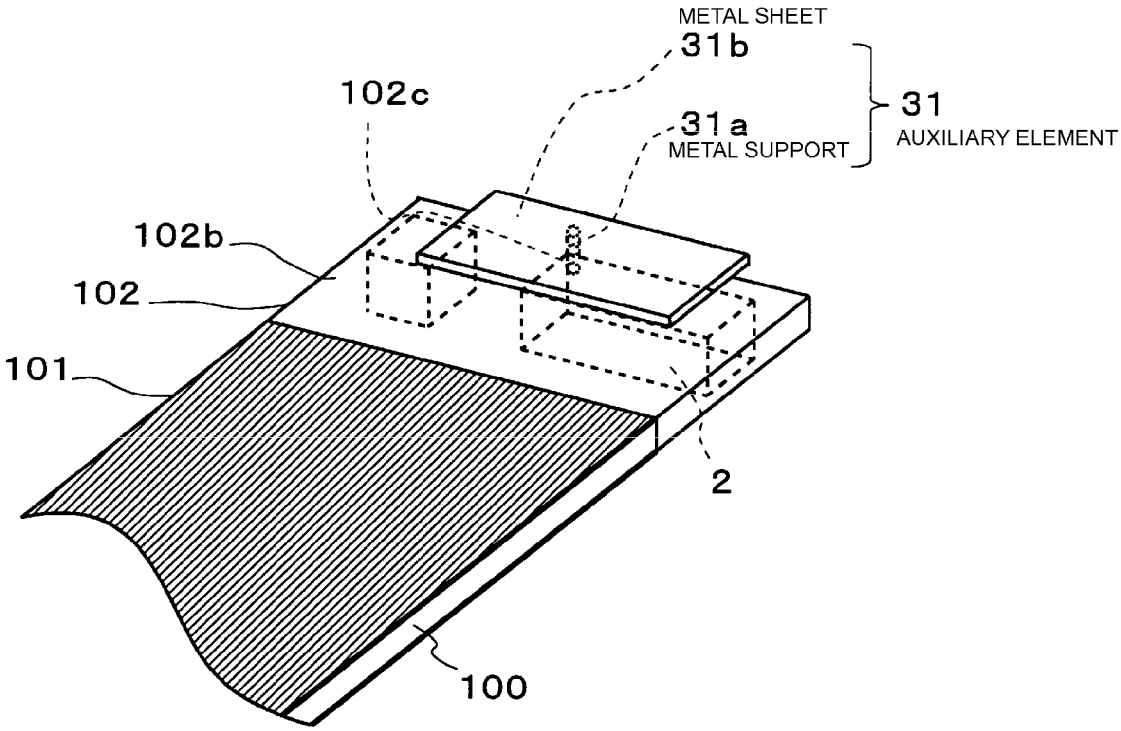
FIG. 5 is a perspective view for illustrating an overall configuration of an auxiliary element of an antenna element.

FIG. 4 is a cutaway side view of the antenna device. FIG. 5 is a perspective view for illustrating an overall configuration of the auxiliary element of the antenna element 3.

As illustrated in FIG. 2, the additional radiation electrode 30 includes an upper electrode 30*b* that branches from the front electrode section 21*a* of the radiation electrode 21 on the upper surface 20*b* of the dielectric base 20, and a side electrode 30*c* and a connecting electrode 30*f* formed on the side surface 20*c* and the lower surface 20*f*, respectively, so as to extend from the upper electrode 30*b*.

As illustrated in FIG. 4, the auxiliary element 31 is disposed on an underside 102*b* of the non-ground region 102, and connected to the additional radiation electrode 30 through a through hole 102*c* provided in the non-ground region 102.

Specifically, as illustrated in FIG. 4 and FIG. 5, the auxiliary element 31 is a three-dimensional electrode including a metal support 31*a* serving as a supporting portion and a metal sheet 31*b* serving as a parallel portion. The through hole 102*c* is provided in the non-ground region 102 and located at a point corresponding to the connecting electrode 30*f* of the additional radiation electrode 30. The metal support 31*a* in the shape of a rod is vertically disposed on the underside 102*b* of the non-ground region 102 while being in the through hole 102*c*. The metal sheet 31*b* is connected to an end of the metal support 31*a* and held to be substantially parallel to the substrate 100. The metal sheet 31*b* preferably is a flat, substantially rectangular metal plate that is smaller in size than the non-ground region 102 and is designed not to extend beyond the non-ground region 102. The metal sheet 31*b* is not in contact with the ground region 101 at any point, and all the edges of the metal sheet 31*b* are open ends.

As illustrated in FIG. 1, the chip antenna 4 includes a dielectric base 40 mounted on the upper side 102*a* of the non-ground region 102 in the substrate 100, and a radiation electrode 41 serving as a second radiation electrode.

Figure 6:
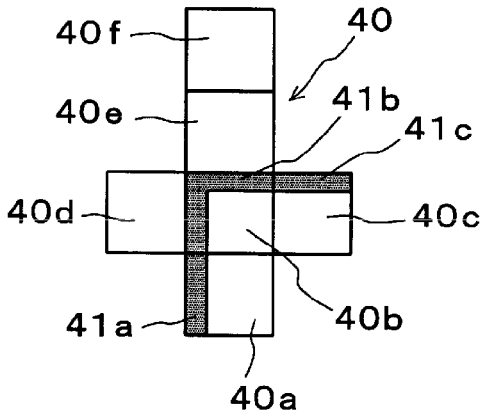
FIG. 6 is a plan view of a second chip antenna developed along sides thereof.
Figure 7:
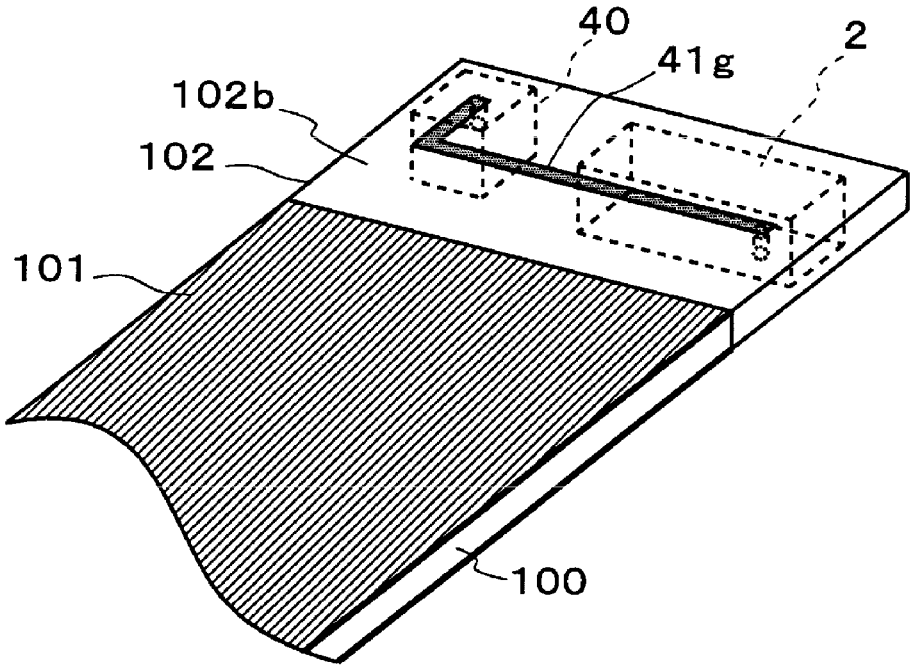
FIG. 7 is a perspective view for illustrating a conductive pattern.

FIG. 6 is a developed view of the chip antenna 4. FIG. 7 is a perspective view for illustrating a conductive pattern.

As illustrated in FIG. 6, the dielectric base 40 preferably has a substantially rectangular parallelepiped shape and has a front surface 40*a*, an upper surface 40*b*, both side surfaces 40*c* and 40*d*, a back surface 40*e*, and a lower surface 40*f*.

The radiation electrode 41 includes a front electrode section 41*a*, a substantially L-shaped upper electrode section 41*b*, and a side electrode section 41*c*. One end of the front electrode section 41*a* is, as illustrated in FIG. 1, connected through a conductive pattern 41*g* to the conductive pattern 111. That is, as illustrated in FIG. 7, the conductive pattern 41*g* is formed on the underside 102*b* of the non-ground region 102, and both ends of the conductive pattern 41*g* are connected via through holes 102*d* and 102*e* to the front electrode section 41*a* and the conductive pattern 111, respectively.

Thus, the radiation electrode 41 of the chip antenna 4 is connected to the power feeder 110 through the conductive pattern 41*g* and the conductive pattern 111, and has a fixed electrical length of the entire chip antenna 4.

Next, functions and effects of the antenna device of the present preferred embodiment will be described.

Figure 8:
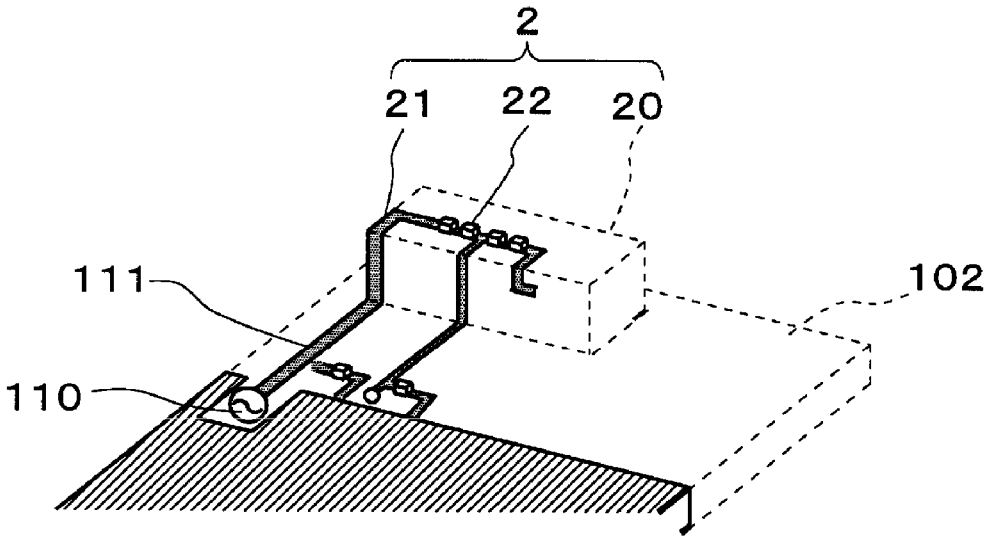
FIG. 8 is a perspective view for illustrating an overall configuration of the first chip antenna.
Figure 9:
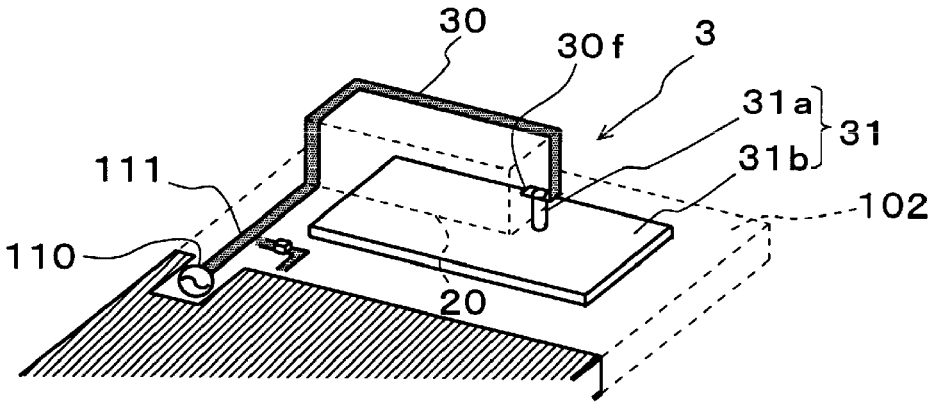
FIG. 9 is a perspective view for illustrating an overall configuration of the antenna element.
Figure 10:
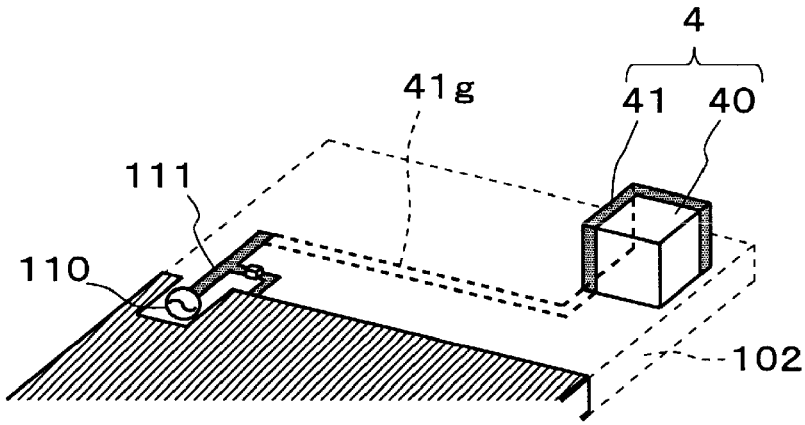
FIG. 10 is a perspective view for illustrating an overall configuration of the second chip antenna.
Figure 11:
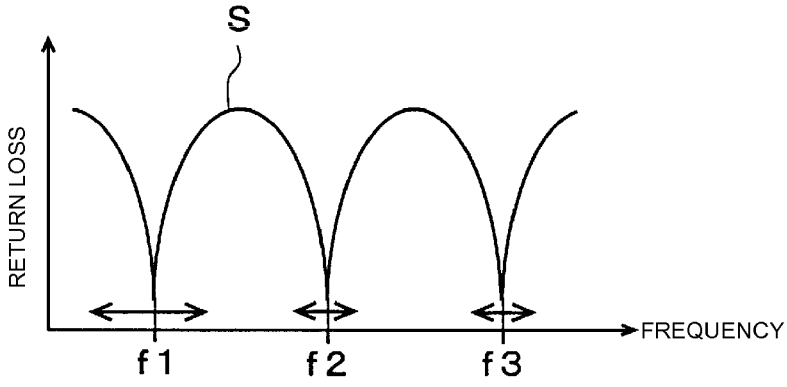
FIG. 11 is a diagram for describing a state of multiple resonance.
Figure 12:
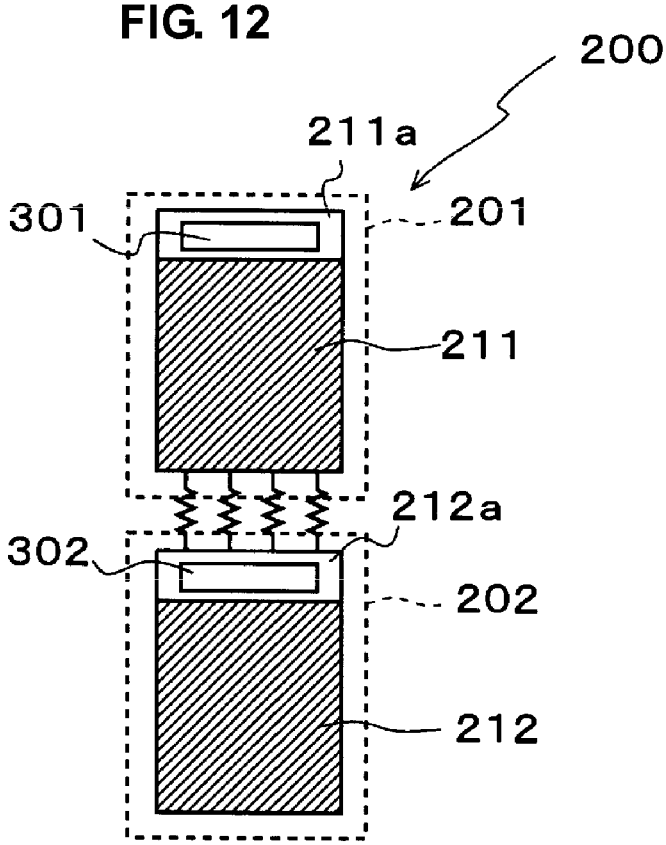
FIG. 12 is a simplified plan view illustrating a state in which substrates of a foldable wireless communication apparatus are housed.

FIG. 8 is a perspective view for illustrating an overall configuration of the chip antenna 2. FIG. 9 is a perspective view for illustrating an overall configuration of the antenna element 3. FIG. 10 is a perspective view for illustrating an overall configuration of the chip antenna 4. FIG. 11 is a diagram for describing a state of multiple resonance. FIG. 12 is a simplified plan view illustrating a state in which substrates of a foldable wireless communication apparatus are housed.

As illustrated in FIG. 8, the chip antenna 2 has an electrical length corresponding to the lengths and shapes of the radiation electrode 21 and the conductive pattern 111. The resonant frequency of the chip antenna 2 can be varied by the frequency variable circuit 22. Since the chip antenna 2 is used in combination with the antenna element 3 and the chip antenna 4, the actual resonant frequency of the chip antenna 2 is different from the resonant frequency of the chip antenna 2 alone. The actual resonant frequency, which is set at f1, can be varied widely by the frequency variable circuit 22.

As illustrated in FIG. 9, the antenna element 3 has an electrical length corresponding to the lengths and shapes of the additional radiation electrode 30, the auxiliary element 31, and the conductive pattern 111. Since the antenna element 3 is used in combination with the chip antenna 2 and the chip antenna 4, the actual resonant frequency of the antenna element 3 is different from the resonant frequency of the antenna element 3 alone. The actual resonant frequency, which is set at f2 and is substantially constant, changes slightly when the frequency variable circuit 22 of the chip antenna 2 widely varies the resonant frequency f1.

As illustrated in FIG. 10, the chip antenna 4 has an electrical length corresponding to the lengths and shapes of the radiation electrode 41, the conductive pattern 41*g*, and the conductive pattern 111. Since the chip antenna 4 is used in combination with the chip antenna 2 and the antenna element 3, the actual resonant frequency of the chip antenna 4 is different from the resonant frequency of the chip antenna 4 alone. This actual resonant frequency, which is set at f3 and is substantially constant, changes slightly when the frequency variable circuit 22 of the chip antenna 2 widely varies the resonant frequency f1.

Thus, as illustrated in FIG. 11, the antenna device 1 has three resonant frequencies f1, f2, and f3. As indicated by arrows, the resonant frequency f1 can be widely varied and the resonant frequencies f2 and f3 can be slightly varied.

Therefore, when the antenna device 1 is incorporated into a wireless communication apparatus 200 as illustrated in FIG. 12, and a signal of frequency f1 is supplied from the power feeder 110 to the antenna device 1 in FIG. 1, the supplied signal resonates with the chip antenna 2, as the actual resonant frequency of the chip antenna 2 is set at f1 as described above. As a result, this signal is transmitted as a radio wave from the entire antenna device 1, mainly from the chip antenna 2, into space. A radio wave of frequency f1 is received by the entire antenna device 1, mainly by the chip antenna 2. Thus, the antenna device 1 of the present preferred embodiment can send and receive a signal of frequency f1 by using mainly the chip antenna 2.

If a signal of frequency f2 is supplied from the power feeder 110 to the antenna device 1, the supplied signal resonates with the antenna element 3, as the resonant frequency of the antenna element 3 is set at f2 as described above. As a result, this signal is transmitted as a radio wave from the entire antenna device 1, mainly from the antenna element 3, into space. A radio wave of frequency f2 is received by the entire antenna device 1, mainly by the antenna element 3. Thus, the antenna device 1 of the present preferred embodiment can send and receive a signal of frequency f2 by using mainly the antenna element 3.

If a signal of frequency f3 is supplied from the power feeder 110 to the antenna device 1, the supplied signal resonates with the chip antenna 4, as the resonant frequency of the chip antenna 4 is set at f3 as described above. As a result, this signal is transmitted as a radio wave from the entire antenna device 1, mainly from the antenna element 3, into space. A radio wave of frequency f3 is received by the entire antenna device 1, mainly by the chip antenna 4. Thus, the antenna device 1 of the present preferred embodiment can send and receive a signal of frequency f3 by using mainly the chip antenna 4.

As described above, the antenna device 1 of the present preferred embodiment is configured such that signals at three different resonant frequencies f1 to f3 can be sent and received by the chip antenna 2, the antenna element 3, and the chip antenna 4. Therefore, it is possible to provide a multiband transmission capability adaptable to various applications. That is, as illustrated in FIG. 11, a return loss curve S showing the lowest return loss at three different frequencies f1 to f3 can be obtained. For example, if the resonant frequency f1 of the chip antenna 2 is set at about 800 MHz, the antenna device 1 can be used for an application such as a mobile phone. At the same time, if the resonant frequency f2 of the antenna element 3 is set at about 1.6 GHz, the antenna device 1 can also be used for an application such as a global positioning system (GPS).

Moreover, in the present preferred embodiment, the auxiliary element 31 of the antenna element 3 is disposed on the underside 102*b* of the non-ground region 102, so as to form the antenna device 1 by using the underside 102*b* as well as the upper side 102*a* of the non-ground region 102. Therefore, dead space and the size of the entire antenna device 1 can be reduced without degrading antenna performance. Furthermore, since the auxiliary element 31 is a three-dimensional electrode effectively extended spatially (in the height direction) as well as horizontally, an antenna volume that is much larger than that of a known antenna device can be obtained in a small space.

As illustrated in FIG. 12, the wireless communication apparatus 200 of foldable type in particular has a structure in which two substrates 211 and 212 are housed in an upper housing 201 and an lower housing 202, respectively. If known techniques are used to produce a multiple-resonance antenna device, an antenna element 301 corresponding to the chip antennas 2 and 4 needs to be mounted in a non-ground region 211*a* of the substrate 211, while an antenna element 302 corresponding to the antenna element 3 needs to be mounted in a non-ground region 212*a* of the substrate 212. On the other hand, since the antenna device 1 of the present embodiment requires only the non-ground region 102 of the substrate 100 as a mounting area, the amount of space taken up by the antenna device can be reduced to half or less than half that in the case of a known antenna device. Moreover, although a large amount of dead space is created on the undersides of the non-ground regions 211*a* and 212*a* in the known antenna device, virtually no such dead space is created in the case of the present preferred embodiment.

Furthermore, since, in the present preferred embodiment, the antenna element 3 includes the radiation electrode 21 disposed on the dielectric base 20 of the chip antenna 2 and the auxiliary element 31, the number of components of the antenna device 1 is smaller than that of the known antenna device, where the chip antenna 2 and the antenna element 3 have to be formed on different substrates.

Second Preferred Embodiment

Figure 13:
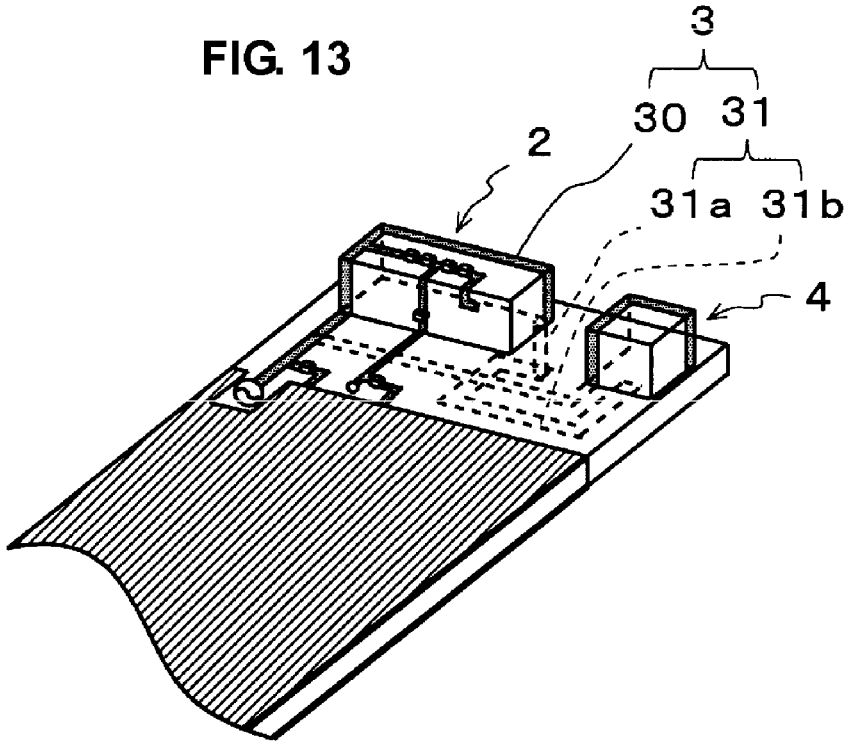
FIG. 13 is a perspective view illustrating the upper side of an antenna device according to a second preferred embodiment of the present invention.
Figure 14:
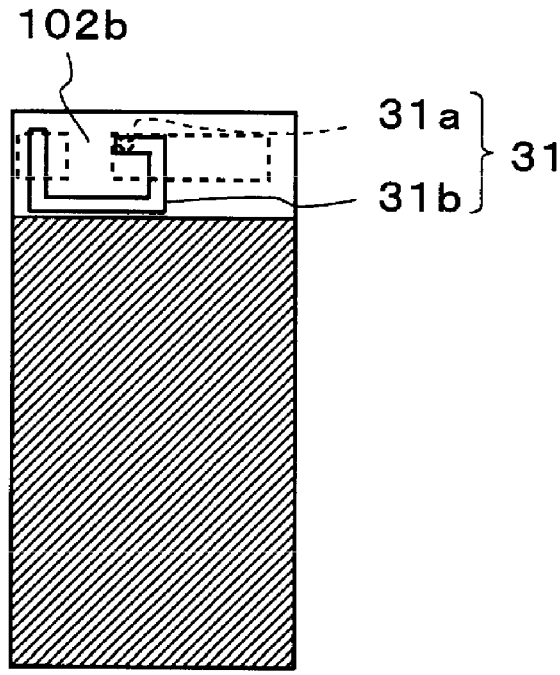
FIG. 14 is a plan view illustrating the underside of the antenna device.
Figure 15:
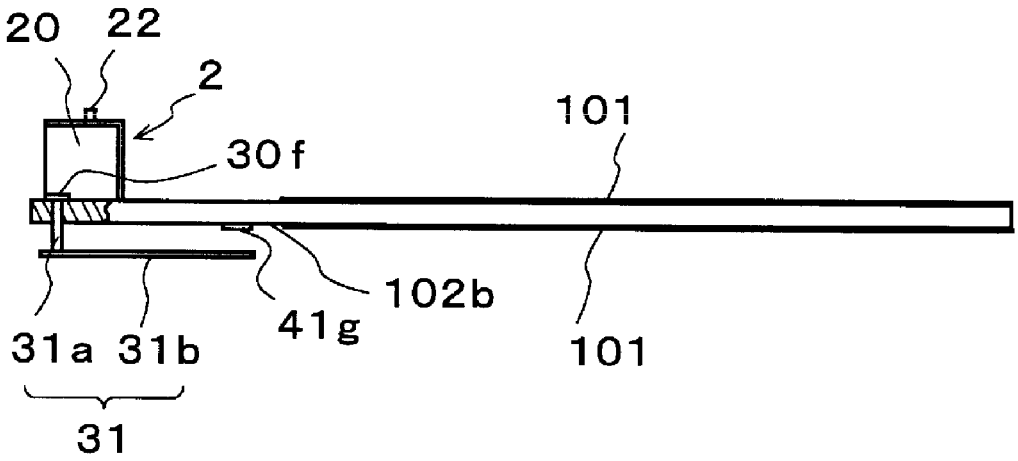
FIG. 15 is a cutaway side view of the antenna device.

FIG. 13 is a perspective view illustrating the upper side of an antenna device according to a second preferred embodiment of the present invention. FIG. 14 is a plan view illustrating the underside of the antenna device. FIG. 15 is a cutaway side view of the antenna device.

As illustrated in FIG. 13 to FIG. 15, in the antenna device of the present preferred embodiment, an auxiliary element 31 of an antenna element 3 includes a metal support 31*a* and a strip-shaped metal sheet 31*b*.

Specifically, the entire strip-shaped metal sheet 31*b* preferably has a substantially U-shaped configuration, and one end of the metal sheet 31*b* is connected to one end of the metal support 31*a* such that the entire metal sheet 31*b* is disposed over an underside 102*b* of a non-ground region 102.

With this configuration, the antenna element 3 can contribute to improved characteristics of the antenna device 1 and can establish another resonance.

The other configurations, functions, and effects are similar to those of the first preferred embodiment and thus will not be described here.

Third Preferred Embodiment

Figure 16:
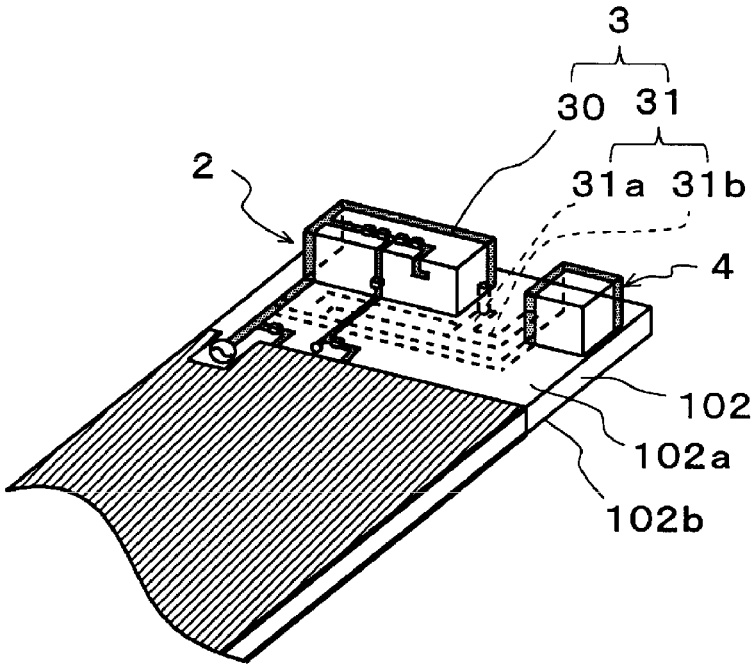
FIG. 16 is a perspective view illustrating the upper side of an antenna device according to a third preferred embodiment of the present invention.
Figure 17:
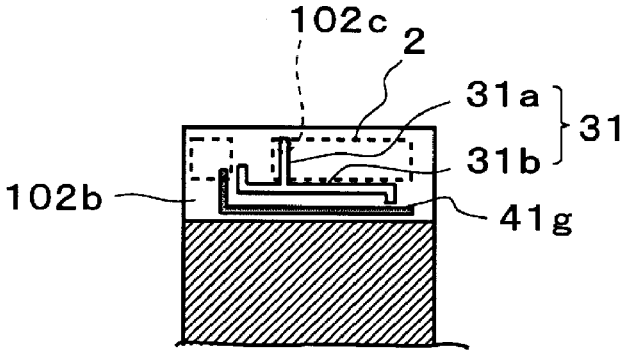
FIG. 17 illustrates the underside of the antenna device.
Figure 18:
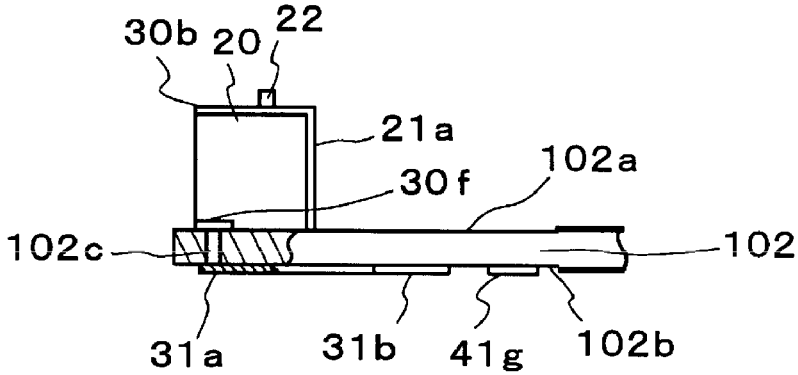
FIG. 18 is a cutaway side view of the antenna device.

FIG. 16 is a perspective view illustrating the upper side of an antenna device according to a third preferred embodiment of the present invention. FIG. 17 illustrates the underside of the antenna device. FIG. 18 is a cutaway side view of the antenna device.

As illustrated in FIG. 16, in the antenna device of the present preferred embodiment, an auxiliary element 31 of an antenna element 3 is a planar electrode.

In other words, as illustrated in FIG. 17 and FIG. 18, the auxiliary element 31 including an extraction pattern 31*a* and a strip-like hook-shaped conductive pattern 31*b* having ends extending in opposite directions is disposed on an underside 102*b* of a non-ground region 102. Specifically, the extraction pattern 31*a* of the auxiliary element 31 is connected to a connecting electrode 30*f* of an additional radiation electrode 30 through a through hole 102*c*.

This configuration contributes to the improved characteristics and reduced thickness of the antenna device 1.

The other configurations, functions, and effects are similar to those of the first preferred embodiment and thus will not be described here.

Fourth Preferred Embodiment

Figure 19:
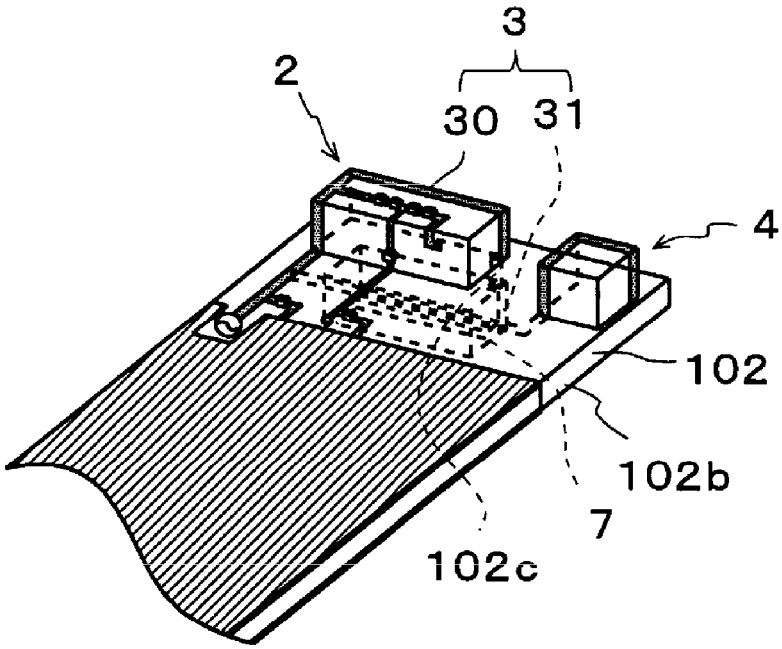
FIG. 19 is a perspective view illustrating the upper side of an antenna device according to a fourth preferred embodiment of the present invention.
Figure 20:
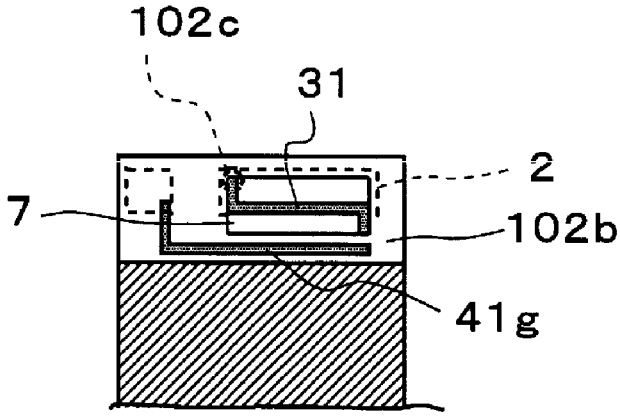
FIG. 20 is a plan view illustrating the underside of the antenna device.
Figure 21:
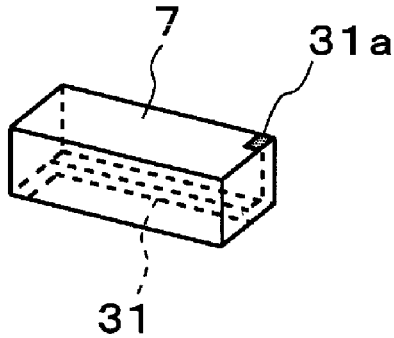
FIG. 21 is a perspective view illustrating a dielectric base.

FIG. 19 is a perspective view illustrating the upper side of an antenna device according to a fourth preferred embodiment of the present invention. FIG. 20 is a plan view illustrating the underside of the antenna device. FIG. 21 is a perspective view illustrating a dielectric base.

In the third preferred embodiment described above, the conductive pattern 31*b* of the auxiliary element 31 of the antenna element 3 is formed directly on the non-ground region 102. In the present preferred embodiment, as illustrated in FIG. 19 to FIG. 21, an auxiliary element 31 of an antenna element 3 is disposed on a dielectric base 7.

Specifically, as illustrated in FIG. 21, a pattern of the auxiliary element 31 is arranged over the lower surface, back surface, and upper surface of the dielectric base 7, which preferably has a substantially rectangular parallelepiped shape. Then, the auxiliary element 31 is connected to an additional radiation electrode 30 by mounting the dielectric base 7 on an underside 102*b* of a non-ground region 102 while an end 31*a* on the upper surface of the dielectric base 7 is in contact with a through hole 102*c* from the underside 102*b*.

Thus, a wavelength reduction effect of the dielectric base 7 can be achieved, and the size of the antenna element 3 can be further reduced.

The other configurations, functions, and effects are similar to those of the third preferred embodiment and thus will not be described here.

Fifth Preferred Embodiment

Figure 22:
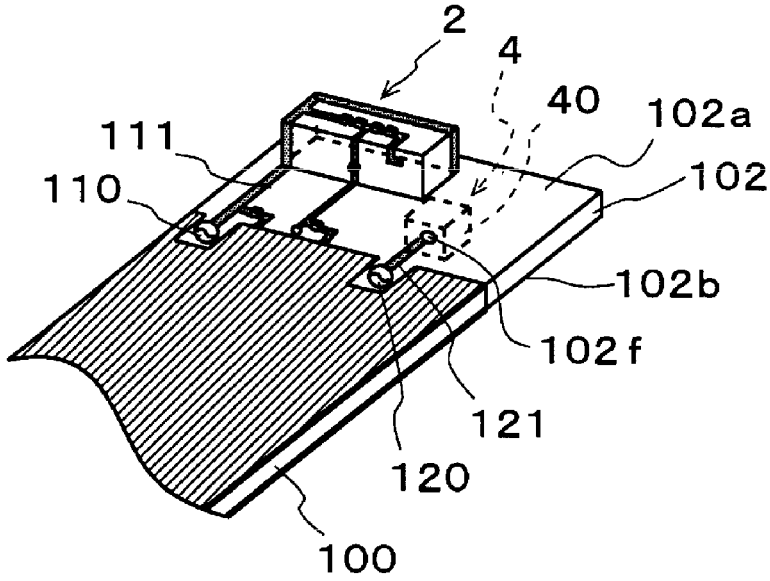
FIG. 22 is a perspective view illustrating the upper side of an antenna device according to a fifth preferred embodiment of the present invention.
Figure 23:
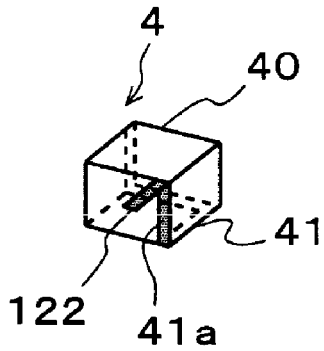
FIG. 23 is a perspective view of a second chip antenna.
Figure 24:
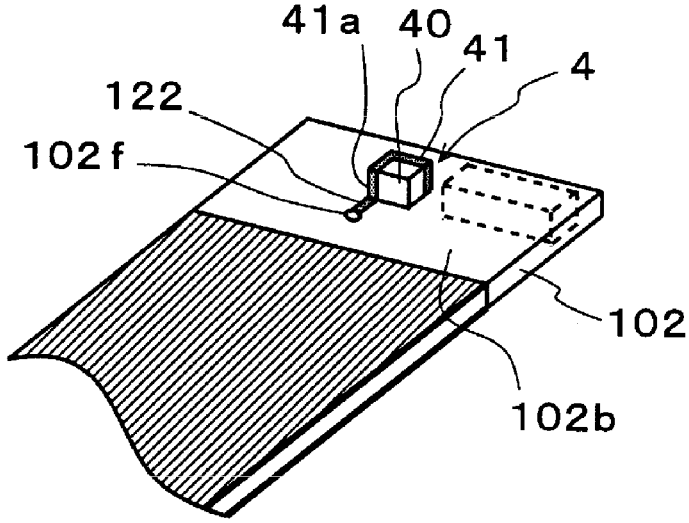
FIG. 24 is a perspective view illustrating the underside of the antenna device.

FIG. 22 is a perspective view illustrating the upper side of an antenna device according to a fifth preferred embodiment of the present invention. FIG. 23 is a perspective view of a chip antenna 4. FIG. 24 is a perspective view illustrating the underside of the antenna device. Note that the illustration of an antenna element 3 is omitted in FIG. 22.

In any one of the preferred embodiments described above, the chip antenna 4 is disposed on the upper side 102*a* of the non-ground region 102 such that the power feeder 110 for the chip antenna 2 can be shared with the chip antenna 4 through the conductive pattern 41*g*. However, in the present preferred embodiment, a chip antenna 4 does not share a power feeder with a chip antenna 2.

In other words, as illustrated in FIG. 22, a power feeder 120 different from a power feeder 110 is provided on the upper side of a substrate 100. Furthermore, a through hole 102*f* is provided in a non-ground region 102, while a conductive pattern 121 from the power feeder 120 is connected to the through hole 102*f*. Then, as illustrated in FIG. 24, a dielectric base 40 is disposed on an underside 102*b* of the non-ground region 102, while a front electrode section 41*a* of a radiation electrode 41 is connected to a conductive pattern 122 drawn from the through hole 102*f* to the underside 102*b* of the non-ground region 102.

With this configuration, the power feeders 110 and 120 are provided to make different feeding points. Since this allows isolation of a plurality of systems of the chip antenna 2 and the chip antenna 4, the resonant frequencies thereof can be controlled independently.

The other configurations, functions, and effects are similar to those of the fourth preferred embodiment and thus will not be described here.

Sixth Preferred Embodiment

Figure 25:
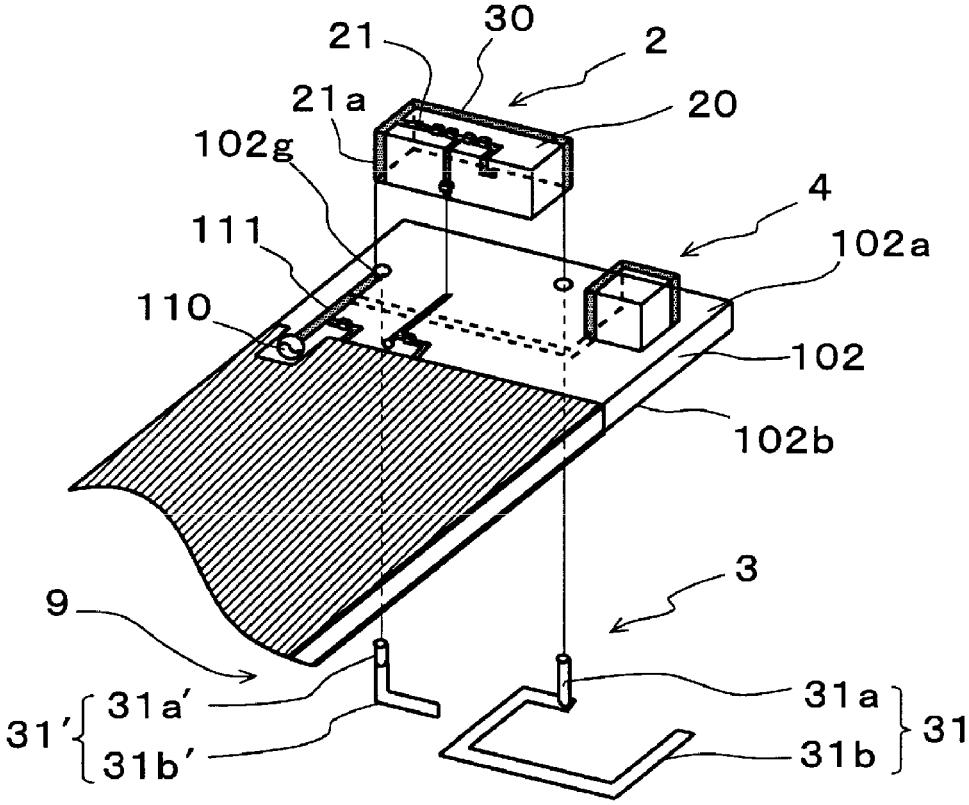
FIG. 25 is an exploded perspective view of an antenna device according to a sixth preferred embodiment of the present invention.
Figure 26:
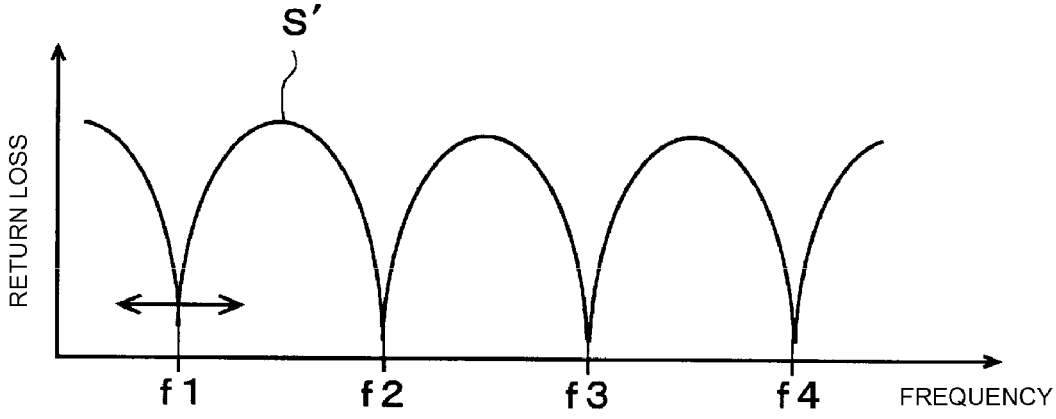
FIG. 26 is a diagram illustrating a state of quadruple resonance.

FIG. 25 is an exploded perspective view of an antenna device according to a sixth preferred embodiment of the present invention. FIG. 26 is a diagram illustrating a state of quadruple resonance.

Although each of the above-described preferred embodiments deals with a triple-resonance antenna device achieved by the chip antenna 2, the antenna element 3, and the chip antenna 4, the number of resonance points is not limited to a specific number. As in the case of the present preferred embodiment, another antenna element 9 can be added to any one of the devices according to the above-described preferred embodiments so as to form a quadruple-resonance antenna device. Such a multiple-resonance antenna device can still maintain its compactness and thin profile.

That is, the antenna device of the present preferred embodiment includes a chip antenna 2, an antenna element 3, and a chip antenna 4 as in the case of the device of the second preferred embodiment, and further includes an auxiliary element 31' on an underside 102*b* of a non-ground region 102. Specifically, a through hole 102*g* connected to an end of a conductive pattern 111 is provided in an upper side 102*a* of the non-ground region 102, while a metal support 31*a'* having a substantially L-shaped metal sheet 31*b'* is connected to the through hole 102*g*. This produces the additional antenna element 9 using the auxiliary element 31' separated from a base of a front electrode section 21*a* through the through hole 102*g* as a total radiation electrode. The antenna element 9 has a resonant frequency f4 corresponding to the length and shape of the auxiliary element 31'.

Thus, in the antenna device of the present preferred embodiment, signals at four different resonant frequencies f1, f2, f3, and f4 can be sent and received by the chip antenna 2, antenna element 3, chip antenna 4, and antenna element 9, respectively. Therefore, as illustrated in FIG. 26, a return loss curve S' showing the lowest return loss at four different frequencies f1, f2, f3, and f4 can be obtained. Thus, the antenna device of the present preferred embodiment allows a multiband transmission capability adaptable to various applications.

The other configurations, functions, and effects are similar to those of the second preferred embodiment and thus will not be described here.

The present invention is not to be considered limited to the preferred embodiments described above, and various modifications and changes can be made within the scope of the present preferred embodiment.

For example, although the auxiliary element of the antenna element is disposed on the underside of the non-ground region in the embodiments described above, it will be obvious that the auxiliary element may be disposed on the upper side of the non-ground region. In other words, the position, size, and number of chip antennas and antenna elements are not limited to those described in the above preferred embodiments, but may be arbitrarily determined.

Additionally, although the dielectric base is used as a base in the preferred embodiments described above, a magnetic base may be used as a base of a chip antenna or the like.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna device comprising:

a first chip antenna including a first radiation electrode and a frequency variable circuit arranged to vary an electrical length of the first radiation electrode provided on a dielectric or magnetic base mounted on an upper side of a non-ground region of a substrate;

at least one antenna element including an additional radiation electrode provided on the base of the first chip antenna and an auxiliary element disposed on the upper side or an underside of the non-ground region and connected to the additional radiation electrode, and having a predetermined electrical length; and a second chip antenna including a second radiation electrode disposed on the dielectric or magnetic base mounted on the upper side or underside of the non-ground region of the substrate, and having a predetermined electrical length.

2. The antenna device according to claim 1, wherein the antenna element includes the auxiliary element disposed on the underside of the non-ground region connected to the additional radiation electrode through a through hole provided in the non-ground region.

3. The antenna device according to claim 1, wherein the number of the antenna elements is more than one, and all resonant frequencies of the plurality of antenna elements are different.

4. The antenna device according to claim 1, wherein the auxiliary element of the antenna element is a planar electrode including a conductive pattern provided in the non-ground region.

5. The antenna device according to claim 1, wherein the auxiliary element of the antenna element is a three-dimensional electrode including a supporting portion vertically disposed in the non-ground region while being connected to the additional radiation electrode, and a parallel portion extending substantially parallel to the substrate from an end of the supporting portion.

6. The antenna device according to claim 5, wherein the parallel portion of the auxiliary element is strip-shaped.

7. The antenna device according to claim 5, wherein the parallel portion of the auxiliary element has a flat plate-shaped configuration.

8. The antenna device according to claim 5, wherein the parallel portion of the auxiliary element does not extend beyond the non-ground region.

9. The antenna device according to claim 5, wherein an end of the parallel portion of the auxiliary element is an open end.

10. The antenna device according to claim 1, wherein the auxiliary element disposed on the underside of the non-ground region is disposed on the dielectric or magnetic base mounted on the underside.

11. The antenna device according to claim 1, wherein a feeding element for the second chip antenna differs from that for the first chip antenna.

12. A wireless communication apparatus comprising an antenna device according to claim 1.

* * * * *